United States Patent [19]

Nishimiya

[11] 4,299,387

[45] Nov. 10, 1981

[54] GAME HAVING A MAGNETIC TARGET CAPABLE OF HOLDING A PLURALITY OF OBJECTS

[75] Inventor: Toru Nishimiya, Tokyo, Japan

[73] Assignee: Tomy Kogyo Co., Inc., Tokyo, Japan

[21] Appl. No.: 125,368

[22] Filed: Feb. 28, 1980

[30] Foreign Application Priority Data

Apr. 23, 1979 [JP] Japan ..... 54-55006[U]

[51] Int. Cl.[3] ..... A63F 7/00

[52] U.S. Cl. ..... 273/119 A

[58] Field of Search ..... 273/108, 109, 118 A, 273/119 A, 127 R, 127 B, 126 A

[56] References Cited

U.S. PATENT DOCUMENTS

| | | | |
|---|---|---|---|
| 581,678 | 4/1897 | Nesbit . | |
| 2,470,159 | 5/1949 | Geary . | |
| 2,477,531 | 7/1949 | Volman . | |
| 2,562,089 | 7/1951 | Fishlove . | |
| 2,853,830 | 9/1958 | Herzog . | |
| 2,903,264 | 9/1959 | Munro et al. . | |
| 2,956,807 | 10/1960 | Luchsinger . | |
| 3,091,464 | 5/1963 | Birdsall et al. | 273/108 |
| 3,406,972 | 10/1968 | Wong | 273/118 A |
| 3,870,308 | 3/1975 | Reilly | 273/126 A |

FOREIGN PATENT DOCUMENTS

| | | | |
|---|---|---|---|
| 412674 | 11/1966 | Switzerland | 273/119 A |
| 198537 | 6/1923 | United Kingdom . | |

*Primary Examiner*—Anton O. Oechsle

*Attorney, Agent, or Firm*—K. H. Boswell; Edward D. O'Brian

[57] ABSTRACT

A game of the type having a housing including a playing surface, an object launcher located in one end of the playing surface and a magnetic target member located on the other end of the playing surface is improved by including a plurality of ferromagnetic objects being independently capable of being propelled by the object launcher toward the magnetic target member. Each of the objects is capable of being attracted to and magnetically held by the magnetic target member except when another of said objects has already been attracted to and is being held by the magnetic target member then the first of said objects which is magnetically held by the target member is made magnetic by the target member and in turn serves as the target for the next of said objects to be launched by the launching member. Subsequent objects launched by the launching member are launched then toward the first of the objects already captured by the magnetic target member. It being the object of the game to capture all of the objects in a straight line.

9 Claims, 4 Drawing Figures

GAME HAVING A MAGNETIC TARGET CAPABLE OF HOLDING A PLURALITY OF OBJECTS

BACKGROUND OF THE INVENTION

This invention is directed to a game wherein a plurality of objects are present which are capable of being launched toward a magnetic target member and if correctly launched on the right trajectory capable of being captured by the target member and being made magnetic. The first of these objects which is captured by the magnetic target member then serves as the target for a subsequent object which, if successfully captured by the first of said objects, then in turn becomes the target for the next object.

The magnetic force between a magnetic object and a ferromagnetic object serves man both as a tool in items such as compasses and magnetic cranes and also as a mystifying force which can be incorporated into games and the like. Many games exist which utilize magnetic forces as a principal basis of the game. Included in this group of games are target games such as those found in U.S. Pat. Nos. 2,562,089 and 2,477,531. In these two patents small magnetic missiles are propelled toward metallic targets. U.S. Pat. No. 3,091,464 complicates this target principle by having the metallic target spinning.

U.S. Pat. No. 2,903,264 improves a board type hockey game by making the puck magnetic which thus allows the puck to not only be flipped by rotatable players, but also to be drawn toward the metal player by the magnetic force between the puck and the player. U.S. Pat. No. 2,470,159 describes a game mimicking a baseball game wherein movable metallic posts representing the team on the playing field can be positioned by moving one or more levers in order to attempt to capture a rollable member representing a batted ball which has a magnet incorporated within it.

U.S. Pat. No. 2,956,807 differs somewhat from the above mentioned patents in that in this patent the repulsive force between two similar poles of two magnets are utilized to move one of the magnets through a maze-like pattern. British Pat. No. 198,537 utilizes electro magnets to attempt to capture an object moving in a circular path above the surface of the electro magnet. U.S. Pat. No. 2,853,830 utilizes a magnetic pencil to move iron filings over the surface of a picture to create comic faces on the picture.

A very early patent, U.S. Pat. No. 581,678 describes a game wherein a magnet is rotatably mounted in the center of a raised platform and a ferromagnetic object in the shape of a sphere is directed through a plurality of grooves with the object being to capture the sphere with the magnet. Finally, U.S. Pat. No. 3,870,308 describes a game wherein a small magnet is launched toward a large circular magnet with the object being to capture the small magnet on the surface of large circular magnet in such a way that the small magnet spins about the surface of the large circular magnet.

While all of the above games are based on the principles of magnetism none of these games are directed to a game wherein once a ferromagnetic object is captured by a magnetic target the ferromagnetic object then serves as a subsequent target. This principle allows the target to be variable, unpredictable and therefore the type of game which both stimulates and holds the player's interest.

BRIEF SUMMARY OF THE INVENTION

In view of the above it is a primary object of this invention to provide a game which is based upon magnetism but differs from previous games in that when a ferromagnetic object is successfully captured by a magnet it then becomes magnetized and therefore subsequently serves as the target. It is a further object to provide a game that because of its simplicity of manufacture and design is both economically produced and can be expected to exhibit both a long useful life while still providing a constantly challenging, interesting and stimulating game.

These objects and others which will become evident from the remainder of this specification are achieved by providing a game having a playing surface, an object launcher and a magnetic target member associated with the playing surface which comprises: a plurality of ferromagnetic objects each capable of being propelled independently across the playing surface by the object launcher and each of the objects independently being capable of being attracted to and magnetically held by the magnetic target member when another of said objects has not already been first attracted to and held by the magnetic target member; the first of said objects which is successfully attracted to and magnetically held by the magnetic target member is then magnetic by its association with the magnetic target member and further serves as the target member for a subsequent of said objects; each of the subsequent objects when successfully attracted to and magnetically held by a previous object is magnetized by the association with the previous object and in turn serves as a target member for the next of the objects to be propelled by the object launcher.

The game can include a housing located on the playing surface which has a recess therein. An opening in the recess serves to allow one object to enter the recess such that it can be located against the surface of the magnetic target member located at the rear of the recess. An object release member slides through the recess and severs the object from the magnetic target member demagnetizing all of the objects and allowing them to be returned to the object launcher for repeat playing of the game.

BRIEF DESCRIPTION OF THE DRAWING

This invention can be better understood when taken in conjunction with the drawing wherein.

The toy illustrated in this specification utilizes certain principles and concepts as are set forth and defined in the amended claims forming a part of this specification. It is to be realized that those experienced in the toy design arts could utilize these principles or concepts in a number of differently appearing embodiments without departing from the spirit or scope of this invention. For this reason this invention is to be construed in light of the appended claims and should not be construed as being limited solely to the embodiment illustrated in the specification and the drawings.

DETAILED DESCRIPTION

Figure 1:
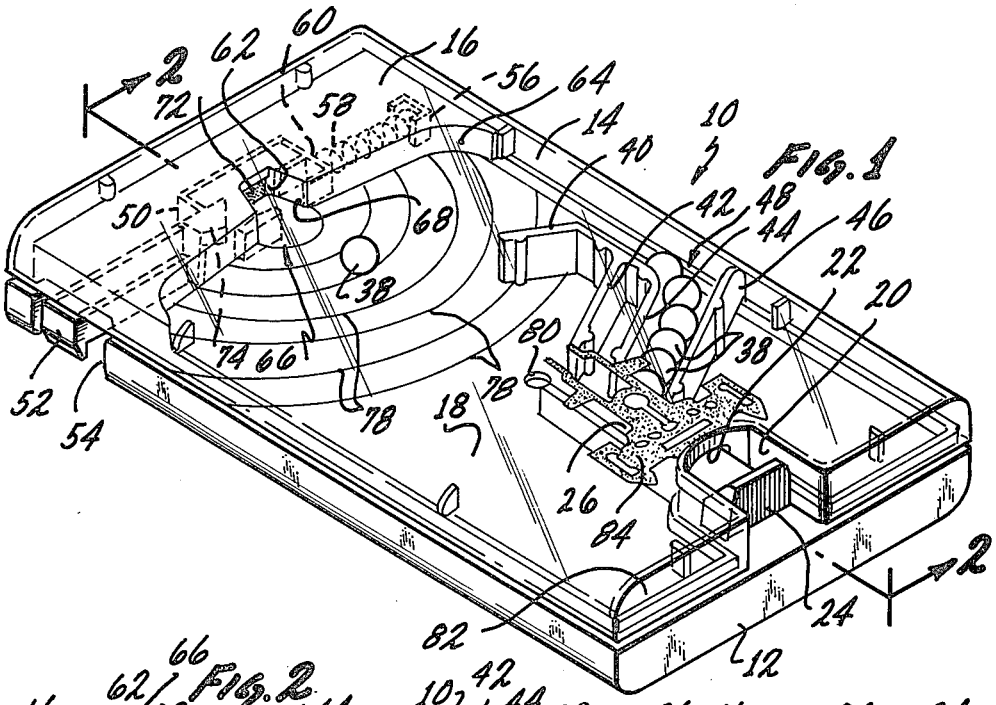
FIG. 1 is an isometric view of the game of this invention.
Figure 2:
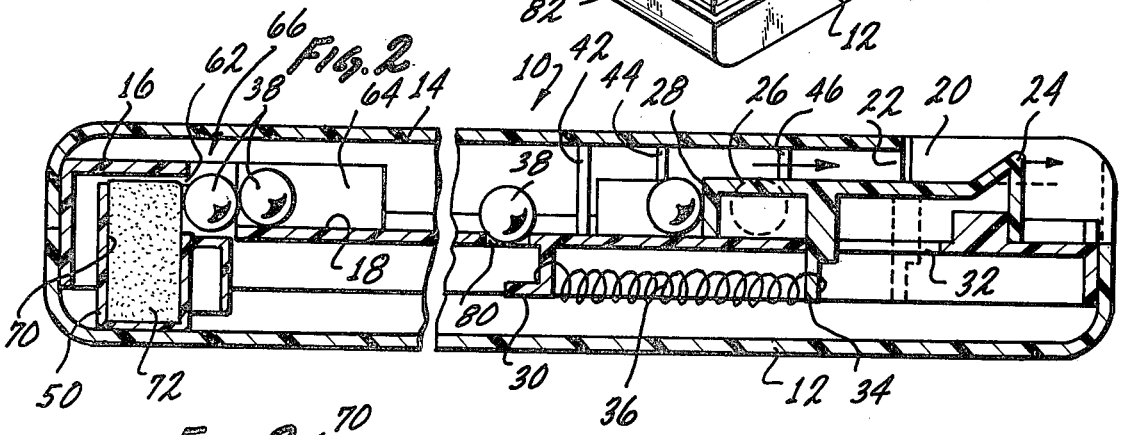
FIG. 2 is a side elevational view in section about the line 2—2 of FIG. 1.

The game 10 of the invention has a lower housing component 12 and an upper transparent housing component 14. Upper housing component 14 is sealed to lower housing component 14 after the remainder of the parts, hereinafter described, are located therein which serves to insure that these parts do not get lost. Located in the upper left hand corner of FIG. 1 is an internal housing component 16. It projects upwardly from playing surface 18 and forms a barrier as hereinafter described.

The upper housing 14 has an indentation 20 which contains an opening 22 through housing 14. Extending out of the opening 22 so it is thus exposed to manipulation of a player's fingers is the lower end 24 of plunger 26. The upper end 28 of plunger 26 is located over playing surface 18 and is exposed to view of the player using the game through upper housing 14. Projecting from the under surface of playing surface 18 is a peg 30. A slot 32 extends along playing surface 18 beneath the plunger 26. Extending downwardly from plunger 26 in slot 32 and integrally formed with plunger 26 is a finger 34. A spring 36 connects the finger 34 to peg 30 and biases the plunger 26 toward the internal housing 16.

A plurality of objects collectively identified by the numeral 38 are located on the playing surface 18 beneath the upper housing 14. A series of baffles identified by the numerals 40, 42, 44 and 46 are integrally formed with the upper housing 14 and extend downwardly from the upper housing 14 toward the playing surface 18. These baffles serve to define guides for the plurality of objects 38 and the area between baffles 44 and 46 defines a feed channel 48 which serves to feed the objects 38 one at a time in front of the upper end 28 of plunger 26.

Located underneath internal housing 16 is a slidable member 50. One end 52 of member 50 extends out of an opening 54 in lower housing 12. This exposes the end 52 of member 50 to manipulation by a player's fingers. A small upright projection 56 projects upwardly from the bottom of lower housing 12 underneath internal housing 16. A compression spring 58 fits between upright projection 56 and the other end 60 of slidable member 50. Compression spring 58 biases slidable member 50 toward opening 54.

Figure 3:
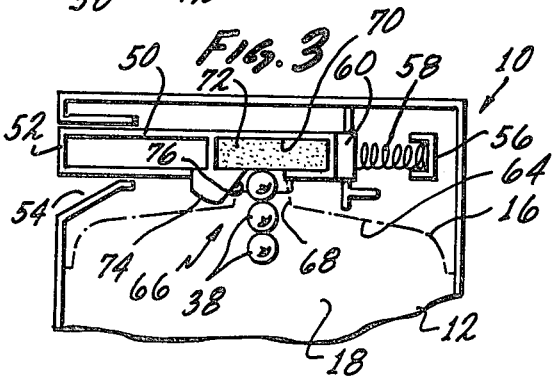
FIG. 3 is a top plan view of the portion of the game found in the upper left hand corner of FIG. 1 showing one spacial relationship of certain components of the game.
Figure 4:
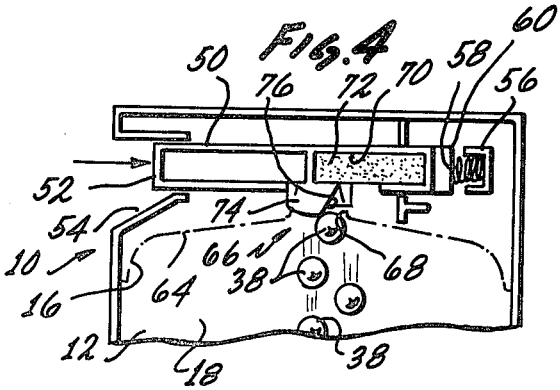
FIG. 4 is the same view as FIG. 3 showing a different spacial relationship of those components.

Internal housing 16 contains a recession or chamber 62 in the middle of it. A wall 64 which is essentially perpendicular to playing surface 18 gradually tapers or curves toward opening 66 in chamber 62. The chamber 62 contains one wall 68 which extends obliquely toward the rear of the chamber 62. Located in a cavity 70 in slidable member 50 is a magnet 72. When the slidable member 50 is in the position shown in FIG. 3 the magnet 72 forms the rear wall of chamber 62. The remaining wall, not numbered, that is the wall on the left hand side, as viewed in FIG. 3 or 4 of chamber 62 is open. Projecting outwardly and integrally formed on sliding member 50 is a finger 74 which has an oblique surface 76 thereon. As seen in FIGS. 3 and 4, as slidable member 50 slides on the lower housing 12 the finger 74 is slid into the chamber 62 and if an object 38 is located within chamber 62 the interaction of the oblique surfaces 76 and 68 serve to displace the object 38 away from the surface of the magnet 72 expelling the object 38 out of the chamber 62. As this happens the magnet 72, since it is located in cavity 70 of slidable member 50, is displaced to the right of wall 68 which further serves to sever the magnetic attraction between the magnet 72 and the object 38.

The objects 38 are in the shape of spheres and are constructed of ferromagnetic material which when isolated exists in a nonmagnetic state, but when placed in the magnetic field of a magnet become magnetized themselves. Located on playing surface 18 are a plurality of concentric circles 78. These circles have their center in the center of chamber 62. They are spaced apart one from the other preferably by the diameter of one of the objects 38. Located directly in front of plunger 26 is a small hole 80 in the surface of playing surface 18. This hole serves to disturb the flight path of the object 38 toward the magnet 72.

It is the object of the game to propel one of the objects 38 toward the magnet 72 which serves as an initial magnetic target member. The first object 38 that is successfully propelled toward and in fact becomes lodged in chamber 62 adheres to the surface of the magnet 72. This then magnetizes this first object and it now serves as a target. Once a first object becomes captured by the magnet 72 and is in fact magnetized by the magnet 72 a second object successfully propelled toward it will strike it and because the first object is magnetized will adhere to the surface of the first object. This then magnetizes the second object, however, since it is at a distance from the magnet 72 greater than the distance of the first object it is not magnetized as strongly as the first object. A further object 38 can now be propelled toward the second object 38 which has become magnetic. If this next object strikes the second object successfully it will adhere to its surface and in turn become magnetized and can serve as a target for even a further object. This sequence is repeated in an attempt to form a single line of all of the objects.

Since each successive object which is captured by the magnet 72 is less magnetic than the object it is attached to, objects closer to the magnet 72 will have a stronger attracting force for objects being propelled by the plunger 26 then will objects more distal from the magnet 72. As more and more objects are attached in a line it becomes more difficult to maintain this line instead of forming branches emanating from objects which are closer to the magnet 72. The skill of the player is measured by how long a chain of objects can be formed. This chain of objects can be recorded by how far out they project in the concentric circules 78 which can be given labels indicating a score.

After all of the objects have been transferred from the feed channel 28 by the plunger 26 and have either been captured by the magnet 72 or allowed to roll back into dead area 82 on the opposite end of the game 10 those objects which are attached to magnet 72 are then released by depressing end 52 of slidable member 50 against the bias of spring 58. This causes oblique surface 76 to move toward wall 68 severing the first object from the magnet 72 as shown in FIG. 4 and thus demagnetizing it which causes all of the other objects which are either in a straight or branched chain from this first object to also be demagnetized releasing them from each other so that they may once again be properly located within feed channel 48. This upper surface of transparent upper housing 14 can contain indicia such as the rocket shaped indicia 84 located over plunger 26 which serves to make the game theme oriented and therefore of a greater play value.

I claim:

1. A game having a playing sufrace, an object launcher and a magnetic target member associated with the playing surface which comprises:

a plurality of ferromagnetic objects each capable of being propelled independently across said playing surface by said object launcher, each of said objects independently capable of being attracted to and magnetically held by said magnetic target member when another of said objects has not already been first attracted to and held by said magnetic target member;

the first of said objects which is attracted and magnetically held by said magnetic target member being made magnetic by said magnetic target member when directly associated with said target member and when magnetized by said magnetic target member then serving as a target member for a subsequent one of said objects, said subsequent one of said objects being magnetized when associated with said first of said objects which is associated with said object target member and said subsequent one of said objects then serving as a target member for the next of said objects to be propelled by said object launcher;

a housing member associated with said playing surface and located over said magnetic target member, said housing member including an opening sized to accept one of said objects and located adjacent to said magnetic target member so as to expose a portion of said magnetic target member through said opening and to allow said first of said objects to be located in said opening proximal to said magnetic target member to magnetize said first of said objects.

2. A game having a playing surface, an object launcher and a magnetic target member associated with the playing surface which comprises:

a plurality of ferromagnetic objects each capable of being propelled independently across said playing surface by said object launcher, each of said objects independently capable of being attracted to and magnetically held by said magnetic target member when another of said objects has not already been first attracted to and held by said magnetic target member;

the first of said objects which is attracted and magnetically held by said magnetic target member being made magnetic by said magnetic target member when directly associated with said target member and when magnetized by said magnetic target member then serving as a target member for a subsequent one of said objects, said subsequent one of said objects being magnetized when associated with said first of said objects which is associated with said object target member and said subsequent one of said objects then serving as a target member for the next of said objects to be propelled by said object launcher;

a housing member associated with said playing surface and located over said magnetic target member, said housing member including an opening located adjacent to said magnetic target member so as to expose at least a portion of said magnetic target member through said opening and to allow said first of said objects to be located proximal to said magnetic target member to magnetize said first of said objects;

said housing member includes a recess means sized to accept only one of said objects, said opening being located on said recess means and said target located adjacent to said recess means distal from said opening allowing said first of said objects to be located within said recess means proximal to said magnetic target member and become magnetized.

3. The game of claim 2 including:

an object release means located in association with said housing member and capable of releasing said first object from its relationship with said magnetic target member to demagnetize said first object.

4. The game of claim 3 wherein:

said object release means includes a release member located in said housing and capable of moving into said recess means and displacing said object from said recess means.

5. The game of claim 4 wherein:

said housing includes a wall essentially vertical to said playing surface, said opening comprises a discontinuity in said surface of said wall, said target member located at a distance from said wall which is essentially the dimension of one of said objects;

said release member fitting adjacent to said wall and capable of moving with respect to said wall between said opening and said target member to displace said object from its abutting relationship from said target member.

6. The game of claim 5 wherein:

said recess means comprises a chamber in said housing and said target means comprises one surface of said chamber, said chamber including a first upstanding surface extending obliquely from said target means and connecting with said wall;

said release member including a second surface extending obliquely to said target member and movable toward said first surface.

7. The game of claim 6 wherein:

said playing surface includes indicator means indicating the number of said objects which are magnetically attracted to one another and to said target means.

8. The game of claim 7 wherein:

said indicator means includes said playing surface having a plurality of concentric circles centered at the point wherein said first object resides within said chamber.

9. The game of claim 8 including:

a transparent cover covering said playing surface and said housing member and serving to maintain said plurality of said ferromagnetic objects on the surface of said playing surface;

guide means associated with said playing surface and said transparent cover to serve as a reservoir for said objects to dispense said objects to said launching member one at a time.

* * * * *